US007725048B2

(12) United States Patent
Goda

(10) Patent No.: US 7,725,048 B2
(45) Date of Patent: May 25, 2010

(54) IMAGE FORMING APPARATUS

(75) Inventor: Mitsuhiro Goda, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 12/149,945

(22) Filed: May 9, 2008

(65) Prior Publication Data

US 2008/0279580 A1 Nov. 13, 2008

(30) Foreign Application Priority Data

May 10, 2007 (JP) ..... 2007-125181

(51) Int. Cl.
*G03G 21/20* (2006.01)

(52) U.S. Cl. ..... 399/92; 399/355

(58) Field of Classification Search ..... 399/91–93, 399/343, 355

See application file for complete search history.

(56) References Cited

U.S. PATENT DOCUMENTS 6,308,024 B1 * 10/2001 Nakayama et al. ..... 399/92
6,785,490 B2 * 8/2004 Tsukamoto et al. ..... 399/119

FOREIGN PATENT DOCUMENTS

JP 2002-6697 A 1/2002
JP 2007-41562 A 2/2007

OTHER PUBLICATIONS

JP 2002-062702 A; machine translation.*
JP 2000-305344 A; machine translation.*

* cited by examiner

*Primary Examiner*—David M Gray
*Assistant Examiner*—Ruth N Labombard
(74) *Attorney, Agent, or Firm*—Smith, Gambrell & Russell, LLP

(57) ABSTRACT

An image forming apparatus has: a housing; a member to be cooled provided inside the housing, the member to be cooled in which heat builds up; an airflow producing portion provided in a predetermined position of the housing for taking in air outside the housing; an air guide member for passing the air thus taken in through a hollow cross-section part, and guiding the air to the member to be cooled to cool the member to be cooled; an air inlet portion provided at one end of the air guide member for taking in the air from the airflow producing portion; and an air blowoff portion provided at another end of the air guide member for sending the air to the member to be cooled, the air blowoff portion in which the cross-sectional area of the hollow cross-section part is smaller than the cross-sectional area of the hollow cross-section part in the air inlet portion.

19 Claims, 11 Drawing Sheets

IMAGE FORMING APPARATUS

This application is based on Japanese Patent Application No. 2007-125181 filed on May 10, 2007, the contents of which are hereby incorporated by reference.

BACKGROUND OF THE INVENTION

1. Field of the Invention

The present invention relates to image forming apparatuses using an electrophotographic process, such as copiers, printers, and facsimiles. More particularly, the present invention relates to an image forming apparatus that can cool a member to be cooled disposed inside the apparatus with an airflow producing portion (cooling fan).

2. Description of Related Art

In image forming apparatuses such as copiers and printers, a heated roller fusing method is widely adopted as a method for fusing an unfused toner image to paper. In the heated roller fusing method, at least one of a pair of rollers forming a nip has a built-in heat source, and paper carrying an unfused toner image is passed through the nip formed between the pair of rollers heated by the heat source, whereby the toner image is fused to the paper. The heat generated by the heat source easily builds up in the image forming apparatus, causing a rise in temperature inside the image forming apparatus. This rise in temperature may affect formation of images. Furthermore, in a developing device, heat is generated, for example, in a sliding portion and blades of an agitator screw as the toner is agitated, unfavorably causing a rise in temperature of the developing device that supplies toner to an image supporting member.

The rise in temperature of the developing device may cause the toner to melt, lowering flowability of the toner and making the toner stick to the screw provided for conveying and agitating the toner. The toner stuck to the screw and eventually deposited thereon may drastically deprive the screw of its toner conveying capability. This adversely affects the toner image developed on the surface of the image supporting member, and results in the formation of an image of unsatisfactory quality on the paper.

To solve this problem, in JP-A-2002-006697, a heat generating portion inside the apparatus body is cooled with a cooling fan. A blowoff port of the cooling fan is connected to toner boxes (portions to be cooled) of developing devices for black, cyan, yellow, and magenta with four ducts provided therebetween. The air from the cooling fan is passed through the ducts and is then blown onto the toner boxes, thereby cooling the toner boxes.

However, this conventional technology has a following drawback. If a space between the blowoff port of the cooling fan and the toner boxes is narrow, it is impossible to provide four ducts. This makes it difficult to cool the toner boxes.

To overcome this drawback, in JP-A-2007-041562, there are provided four flexible tubes each having, at one end thereof, an air inlet portion at which they are connected to a cooling fan, and having, at the other end thereof, an air blowoff portion that is attached so as to face the bottom surface of the toner box. The air from the cooling fan is taken in, and is made to flow through the four flexible tubes from the front toward the rear of the toner boxes along the bottom surfaces thereof. With this structure, even when there is no space to provide the ducts, it is possible to cool the toner boxes.

However, this conventional technology has the following drawbacks. The air coming from the cooling fan and taken into the flexible tubes does not reach all the way to the rear of the toner boxes. As a result, the degree of temperature rise differs between the front and rear ends of the toner boxes. That is, although the rise in temperature can be prevented near the front end of the toner boxes, the temperature continues to rise near the rear end thereof. This unfavorably makes the toner inside the toner boxes less flowable. The toner boxes are not the only ones that will be affected. In a fusing unit, too, the heat generated by a heat source such as a built-in heater of a fusing roller is transferred to a nearby paper conveying portion. This transferred heat unfavorably distorts the image fused to the paper.

SUMMARY OF THE INVENTION

In view of the conventionally experienced problems described above, it is an object of the present invention to provide an image forming apparatus that can form high and stable quality images by guiding air taken in from an airflow producing portion (cooling fan) from the front end of a member to be cooled and making it reach all the way to the rear end thereof, so as to prevent a rise in temperature not only near the front end of the member to be cooled but also near the rear end thereof.

To achieve the above object, according to one aspect of the present invention, an image forming apparatus is provided with: a housing; a member to be cooled provided inside the housing, the member to be cooled in which heat builds up; an airflow producing portion provided in a predetermined position of the housing for taking in air outside the housing; an air guide member for passing the air thus taken in through a hollow cross-section part, and guiding the air to the member to be cooled to cool the member to be cooled; an air inlet portion provided at one end of the air guide member for taking in the air from the airflow producing portion; and an air blowoff portion provided at another end of the air guide member for sending the air to the member to be cooled, the air blowoff portion in which the cross-sectional area of the hollow cross-section part is smaller than the cross-sectional area of the hollow cross-section part in the air inlet portion. With this structure, the airflow producing portion sends the air outside the housing to the air inlet portion of the air guide member, and the air is passed through the hollow cross-section part into the air blowoff portion and is then sent to the member to be cooled.

Thus, since the air is blown out of the air blowoff portion toward the member to be cooled at high pressure and hence at high wind velocity, cool air is made to flow throughout the entire length of the member to be cooled. This helps prevent the rise in temperature not only near the front end of the member to be cooled but also near the rear end thereof, making it possible to form high and stable quality images with the image forming portion in which the member to be cooled is disposed. In addition, there is no need for a larger and higher-performance airflow producing portion to increase, for example, the quantity of air supplied by the airflow producing portion, making it possible to achieve a reduction in size as well as in the cost of the apparatus.

Preferably, in the image forming apparatus structured as described above, the member to be cooled is a toner box containing toner. With this structure, the airflow producing portion sends the air outside the housing to the air inlet portion of the air guide member, and the air is passed through the hollow cross-section part into the air blowoff portion and is then sent to the toner box.

Thus, since the air is blown out of the air blowoff portion toward the toner box at high wind velocity, the cool air is made to flow throughout the entire length of the toner box. This helps prevent the rise in temperature not only near the front end of the toner box but also near the rear end thereof, and prevent the toner inside the toner box from melting by heat. As a result, the flowability of toner is improved, making it possible to form high and stable quality images. In addition, there is no need for a larger and higher-performance airflow producing portion to increase, for example, the quantity of air supplied by the airflow producing portion, making it possible to achieve a reduction in size as well as in the cost of the apparatus.

Preferably, in the image forming apparatus structured as described above, the air blowoff portion sends the air along the bottom surface of the toner box.

Thus, the toner located inside the toner box in the lower part thereof is cooled by the air sent along the bottom surface of the toner box. This improves the flowability of the toner inside the toner box.

Preferably, in the image forming apparatus structured as described above, the toner box extends in a lengthwise direction, and, at one end thereof in the lengthwise direction, the air blowoff portion is disposed.

Thus, cool air is sent from one end of the toner box to the other end thereof in the lengthwise direction. This helps prevent the rise in temperature of the toner box throughout its entire length even when the toner box has a shape elongated in the lengthwise direction, and prevent the toner inside the toner box from melting by heat. As a result, the flowability of toner is improved.

Preferably, in the image forming apparatus structured as described above, one airflow producing portion is provided in a predetermined position of the housing, a plurality of toner boxes are provided inside the housing, and a plurality of air guide members each take in the air from the airflow producing portion, and guide the air to a corresponding one of the toner boxes.

Thus, it is possible to guide the air taken in by a common airflow producing portion to a plurality of toner boxes. As a result, even when there is no space to provide a plurality of airflow producing portions on the outer surface or the like of the housing, it is possible to cool the plurality of toner boxes.

Preferably, the image forming apparatus structured as described above is further provided with: a fusing unit provided inside the housing for fusing a toner image to paper by applying heat and pressure to the paper; and a paper conveying portion provided on a downstream side of the fusing unit along a paper conveying direction for conveying the paper to which the toner image is fused. Here, the member to be cooled is the paper conveying portion.

Thus, the image formed on the paper subjected to the fusing process is prevented from being smeared. This contributes to high and stable quality images.

Preferably, in the image forming apparatus structured as described above, the air blowoff portion is disposed so as to send the air from one end of the paper conveying portion to the other end thereof in a direction perpendicular to the paper conveying direction of the paper conveying portion.

Thus, since the cool air is made to flow from one end of the paper conveying portion to the other end thereof, the rise in temperature of the paper conveying portion can be prevented throughout its length even when the paper conveying portion has a shape elongated from one end to the other end thereof. This helps prevent the water droplets from adhering to the paper conveying portion, eliminating the possibility of the image formed on the paper subjected to the fusing process being smeared.

Preferably, in the image forming apparatus structured as described above, the paper conveying portion is disposed above the fusing unit. Usually, if the paper containing moisture is subjected to the fusing process in the fusing unit, hot, moisture-laden air moves upward through the paper conveying portion, and this air turns into water droplets in the paper conveying portion. With this structure, however, since the cool air is sent to the paper conveying portion, the rise in temperature of the paper conveying portion is prevented. In addition, the cool air diffuses the hot, moisture-laden air, preventing the water droplets from adhering to the paper conveying portion.

Thus, even when the paper conveying portion is disposed above the fusing unit, there is no possibility of the image formed on the paper subjected to the fusing process being smeared. This makes it possible to form high and stable quality images.

Preferably, in the image forming apparatus structured as described above, the air guide member is formed as a tube having flexibility. With this structure, the air guide member can be transformed into a shape that allows it to fit through a space between the airflow producing portion and the member to be cooled.

Thus, even when there is no space between the airflow producing portion and the member to be cooled, it is possible to dispose the air guide member near the member to be cooled. This makes miniaturization of the apparatus possible.

Preferably, in the image forming apparatus structured as described above, the air guide member is formed as a tube having heat insulating properties. With this structure, the air guide member is less affected by the heat inside the housing when the air taken in through the air inlet portion is passed through the hollow cross-section part to the air blowoff portion.

Thus, there is no possibility of the air that is taken in from the airflow producing portion and is then passed through the hollow cross-section part to the member to be cooled becoming warm due to the heat inside the housing. This makes it easier to send the cool outside air to the member to be cooled.

Preferably, in the image forming apparatus structured as described above, the cross-sectional shape of the hollow cross-section part in the air blowoff portion is elliptical. With this structure, it is easy to form the hollow cross-section part in the air blowoff portion of the air guide member formed as a tube.

Thus, it is possible to easily make the cross-sectional area of the hollow cross-section part in the air blowoff portion smaller than the cross-sectional area of the hollow cross-section part in the air inlet portion.

Preferably, in the image forming apparatus structured as described above, the air blowoff portion has a slit formed at an end face thereof in a direction perpendicular to the end face. With this structure, the air guide member formed as a tube can be easily transformed into an ellipse.

Thus, it is possible to easily make the cross-sectional area of the hollow cross-section part in the air blowoff portion smaller than the cross-sectional area of the hollow cross-section part in the air inlet portion, and attach the air blowoff portion to the housing or the like with ease.

Preferably, in the image forming apparatus structured as described above, the air blowoff portion is attached to an elliptical hole formed in the housing.

Thus, since the air blowoff portion is attached to the elliptical hole, it is possible to easily attach the air blowoff portion to the housing or the like.

Preferably, in the image forming apparatus structured as described above, when the air blowoff portion is inserted into a hole formed in the housing, the air blowoff portion is transformed according to the shape of the hole and is fixed in the hole.

Thus, it is possible to securely attach the air blowoff portion to the housing or the like with ease.

DETAILED DESCRIPTION OF PREFERRED EMBODIMENTS

Hereinafter, an embodiment of the present invention will be described with reference to the accompanying drawings. It is to be understood that the present invention is not limited in any way by the embodiment thereof described below, because this embodiment is merely an example of how the invention can be preferably implemented. In addition, the application of the invention and the terms or the like used in the present specification are not limited to those specifically described below.

Figure 1:
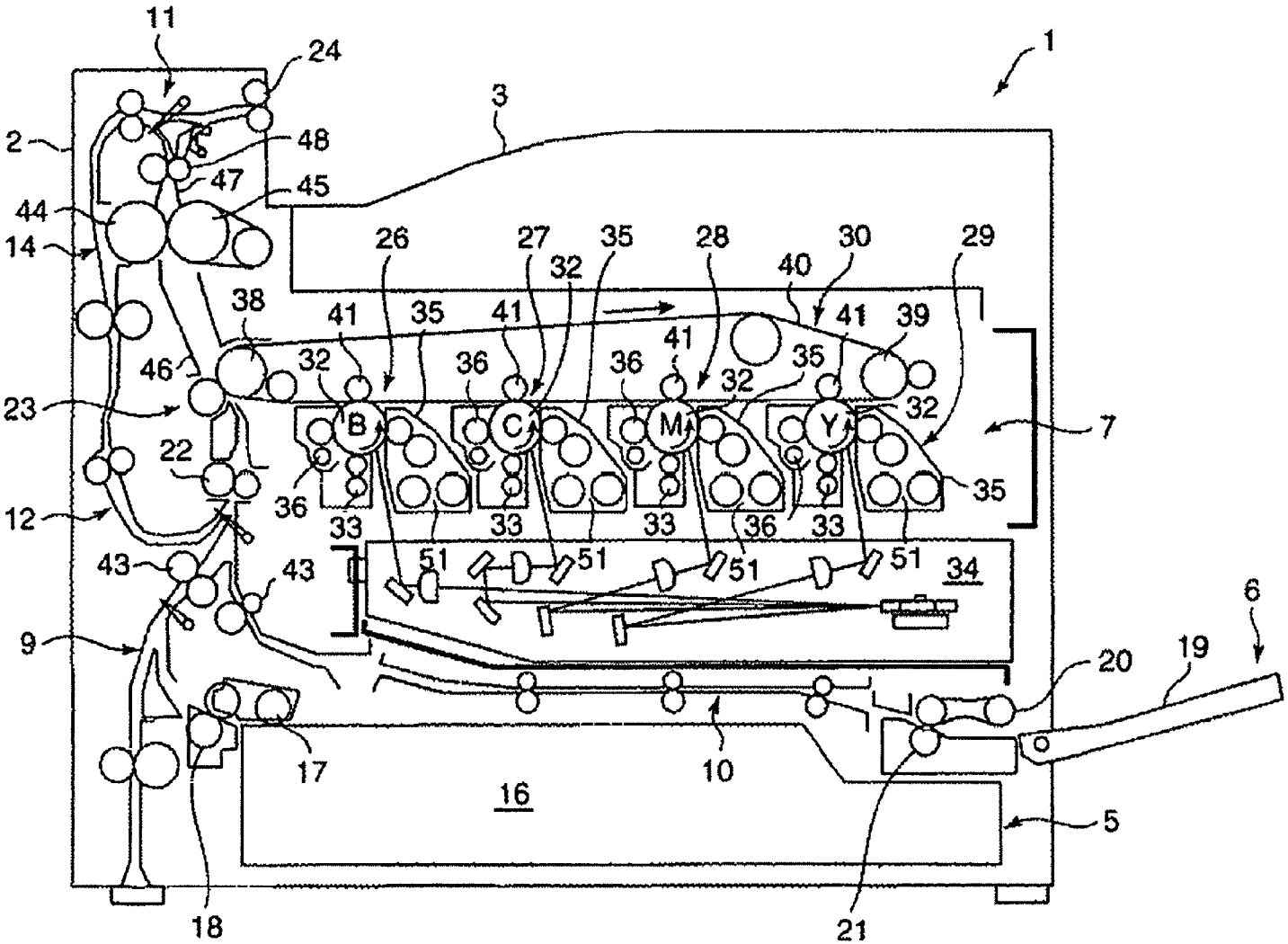
FIG. 1 is a sectional view showing an image forming apparatus according to an embodiment of the invention.

FIG. 1 is a diagram schematically showing the internal structure of an image forming apparatus 1 according to the embodiment of the invention. The image forming apparatus 1 is a tandem-type color printer, and includes a box-shaped housing 2 (hereinafter an "apparatus body 2") inside which a color image is formed on paper. The apparatus body 2 has, on the top face thereof, a paper ejecting portion 3 into which the paper on which the color image is formed is ejected.

Inside the apparatus body 2, a paper cassette 5 in which paper is placed, a stack tray 6 that allows paper to be manually fed, and an image forming portion 7 that forms an image on the paper based on image data such as text and graphics transmitted from the outside of the apparatus are disposed in lower, middle, and upper parts, respectively, of the apparatus body 2. Disposed in a left part of the apparatus body 2 is a first conveying path 9 that conveys the paper fed from the paper cassette 5 to the image forming portion 7. Extending from a right to left part of the apparatus body 2 is a second conveying path 10 that conveys the paper fed from the stack tray 6 to the image forming portion 7. Disposed in an upper left part of the apparatus body 2 are a fusing unit 14 in which the image formed on the paper in the image forming portion 7 is fused, and a third conveying path 11 that conveys the paper on which the image is fused to the paper ejecting portion 3.

The paper cassette 5 is taken out of the apparatus body 2 (in FIG. 1, toward the viewer facing it) so that the paper can be added. The paper cassette 5 is provided with a cassette 16 that can selectively accommodate at least two types of paper that differ in size in a paper feed direction. The paper accommodated in the cassette 16 is fed toward the first conveying path 9 one at a time with a pickup roller 17 and a separating roller 18.

The first conveying path 9 conveys the paper fed from the paper cassette 5 toward a transfer/conveying portion 30, which will be described later. The first conveying path 9 includes a plurality of conveying rollers 43 that are disposed in predetermined positions, and a resist roller 22 that is disposed upstream from the transfer/conveying portion 30 for synchronizing image forming operation performed by the image forming portion 7 and paper feed operation.

The stack tray 6 has, outside of the apparatus body 2 on the right side thereof, a tray 19 on which manually-fed paper is stacked. The paper stacked on the tray 19 is fed toward the second conveying path 10 one at a time with a pickup roller 20 and a separating roller 21.

The first conveying path 9 and the second conveying path 10 join together upstream from the resist roller 22. A full-color toner image on a primary transfer belt 40, which will be described later, is second-transferred to the paper with a secondary transfer roller 23, and is then fused to the paper in the fusing unit 14. The paper to which the image is fused is inverted as needed by using a fourth conveying path 12, such that a full-color toner image is second-transferred to the reverse side of the paper with the secondary transfer roller 23, and is then fused thereto in the fusing unit 14. The resultant paper is conveyed over the third conveying path 11 provided with a conveying roller 48 and an ejection roller 24 disposed on the exit side thereof, and is then ejected into the paper ejecting portion 3 with the ejection roller 24.

The image forming portion 7 includes a first image forming unit 26 that forms a black (Bk) toner image, a second image forming unit 27 that forms a cyan (C) toner image, a third image forming unit 28 that forms a magenta (M) toner image, a fourth image forming unit 29 that forms a yellow (Y) toner image, and the transfer/conveying portion 30 that transfers a full-color toner image formed by the image forming units 26 to 29 to the paper.

The image forming units 26 to 29 each have a photoconductor drum 32, a developing portion 35 that is disposed so as to face a circumferential surface of the photoconductor drum 32, a charging portion 33 that is disposed so as to face the circumferential surface of the photoconductor drum 32 on the upstream side of the developing portion 35 along a rotation direction of the photoconductor drum 32, and a cleaning portion 36 that is disposed so as to face the circumferential surface of the photoconductor drum 32 on the downstream side of the developing portion 35 along a rotation direction of the photoconductor drum 32. A laser scanning unit 34 irradiates a predetermined position on the circumferential surface of the photoconductor drum 32 with a laser beam, the predetermined position located downstream side of the charging portion 33 along a rotation direction of the photoconductor drum 32.

The photoconductor drums 32 of the image forming units 26 to 29 are rotated by an unillustrated drive motor in a counterclockwise direction as indicated in the figure. The developing portions 35 of the image forming units 26 to 29 have toner boxes 51, which serve as toner containers, containing black toner, cyan toner, magenta toner, and yellow toner, respectively.

The transfer/conveying portion 30 includes a driving roller 38 disposed near the first image forming unit 26, a driven roller 39 disposed near the fourth image forming unit 29, the primary transfer belt 40 that is stretched taut between the driving roller 38 and the driven roller 39, and primary transfer rollers 41 that are disposed on the downstream side of the developing portions 35 of the image forming units 26 to 29 along a rotation direction of the primary transfer belt, so as to make contact with the photoconductor drums by pressurizing with the primary transfer belt 40 placed in between.

In the transfer/conveying portion 30, the toner images are sequentially transferred to the primary transfer belt 40 at the positions where the primary transfer rollers 41 of the image forming units 26 to 29 are disposed. In this way, the toner images of four colors are laid one on top of another, and a full-color toner image is obtained.

The fusing unit 14 performs a fusing process by applying heat to the paper to which the toner images are transferred in the image forming portion 7. The fusing unit 14 includes a fusing roller 45 that is heated with a built-in heater, and a pressure roller 44 that is disposed so as to make contact with the fusing roller 45 by pressurizing. There are provided an upstream-side conveying path 46 disposed on the upstream side of the fusing roller 45 and the pressure roller 44 along a paper conveying direction, the upstream-side conveying path 46 guiding the paper conveyed by the transfer/conveying portion 30 to pass between the fusing roller 45 and the pressure roller 44, and a downstream-side conveying path 47 disposed on the downstream side of the fusing roller 45 and the pressure roller 44 along a paper conveying direction, the downstream-side conveying path 47 guiding the paper passed between the fusing roller 45 and the pressure roller 44 to the third conveying path 11.

The third conveying path 11 conveys the paper subjected to the fusing process in the fusing unit 14 to the paper ejecting portion 3. Along the third conveying path 11, the conveying roller 48 is disposed in a predetermined position, and the ejection roller 24 is disposed on the exit side thereof. The paper to which the image is fused in the fusing unit 14 is inverted as needed by using the fourth conveying path 12, such that a full-color toner image is second-transferred to the reverse side of the paper with the secondary transfer roller 23, and is then fused thereto in the fusing unit 14. The resultant paper is conveyed over the third conveying path 11, and is then ejected into the paper ejecting portion 3 with the ejection roller 24.

Incidentally, the toner boxes 51 are provided in the developing portions 35 of the image forming units 26 to 29 of the image forming portion 7 for the storage and agitation of black toner, cyan toner, magenta toner, and yellow toner, respectively. In these four toner boxes (portions to be cooled) 51, heat is generated, for example, in the built-in heater of the fusing roller 45 and in a sliding portion and blades of an agitator screw as the toner is agitated. The generated heat may make the toner less flowable, making it impossible to form images of satisfactory quality.

Figure 2:
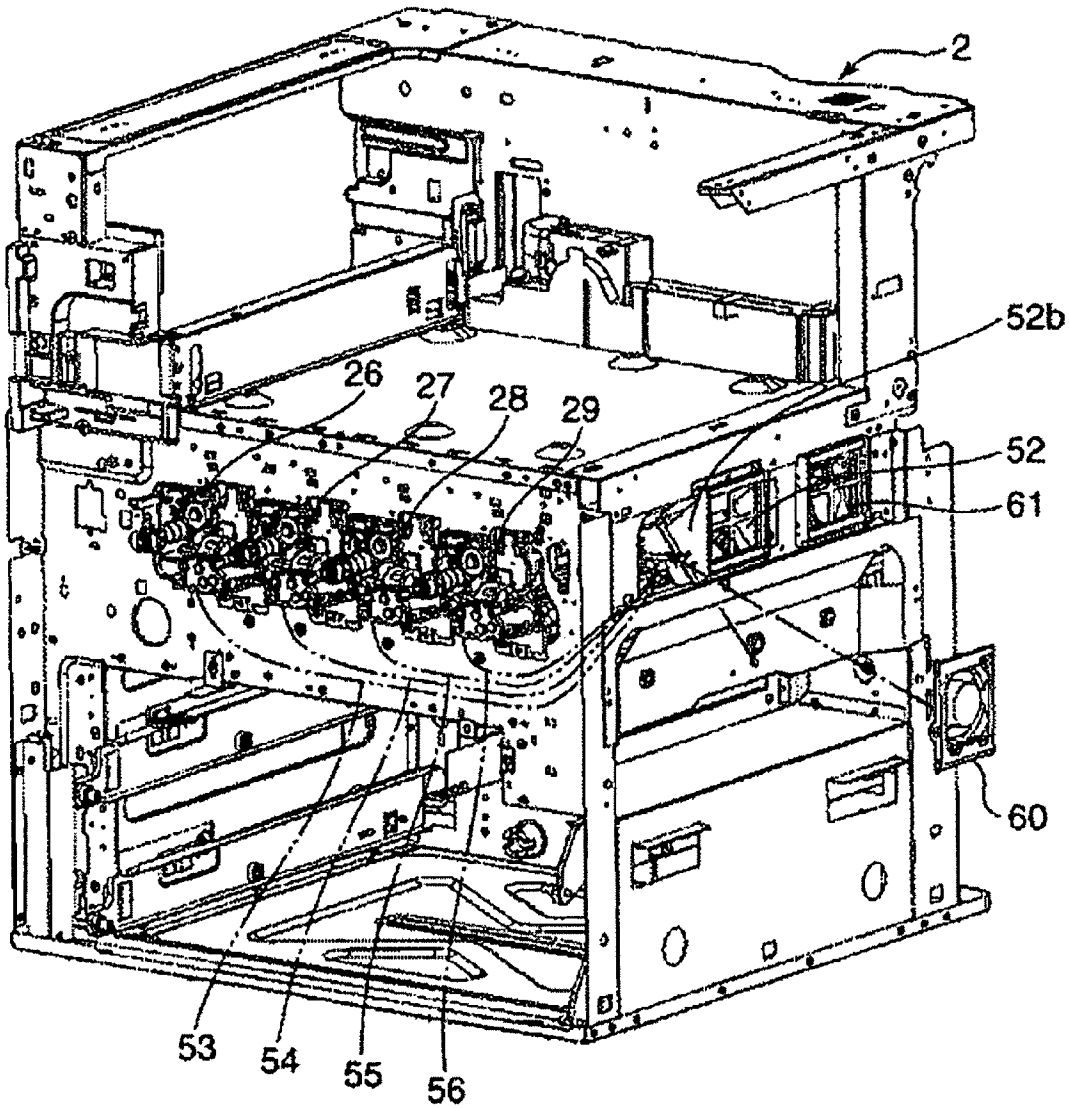
FIG. 2 is a perspective view showing a positional relationship between image forming units and a cooling fan, which are provided inside the apparatus body of the image forming apparatus according to the embodiment of the invention.
Figure 3:
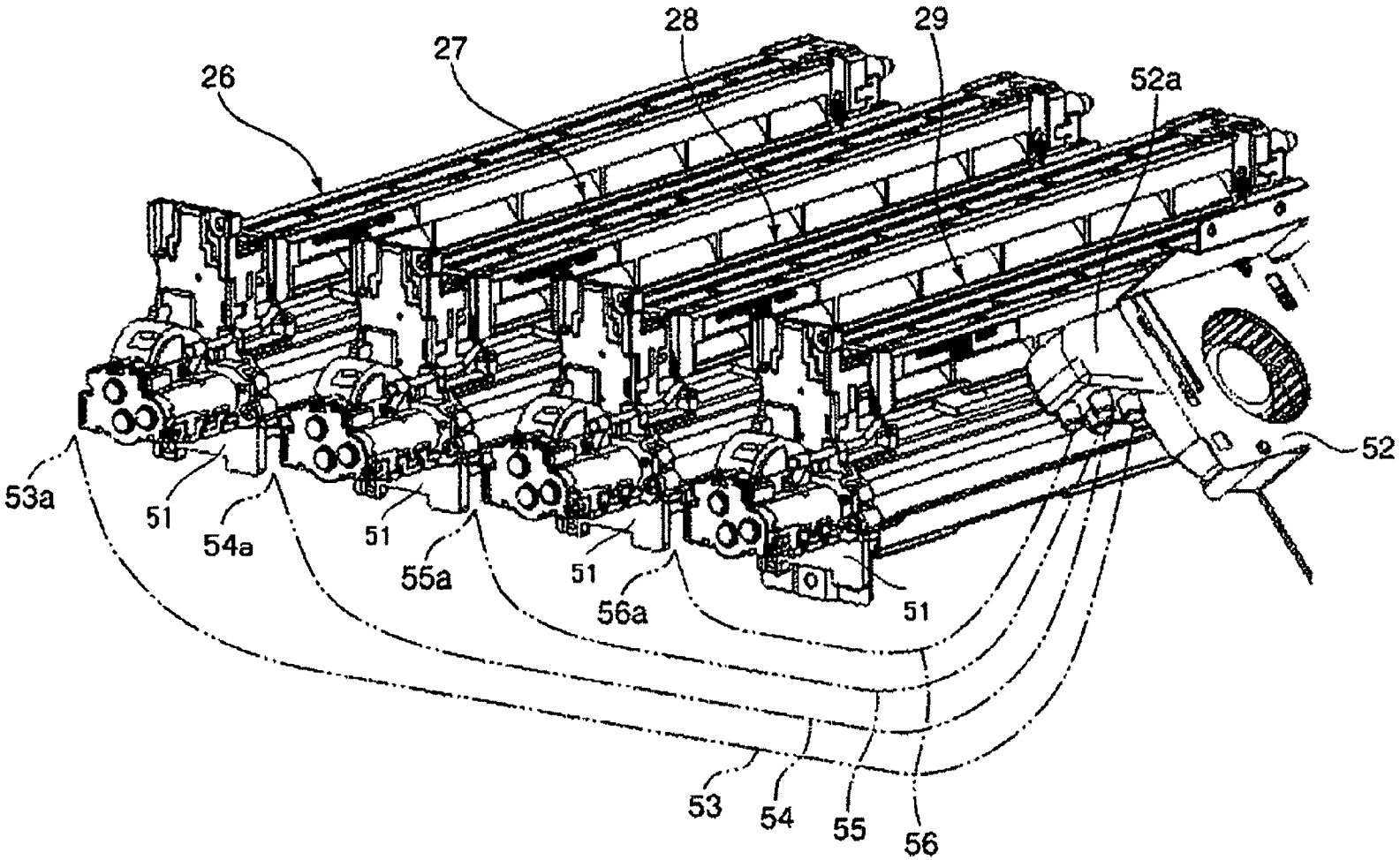
FIG. 3 is a perspective view showing a positional relationship between the image forming units and the cooling fan of the image forming apparatus according to the embodiment of the invention, and how flexible tubes connect between them.
Figure 4:
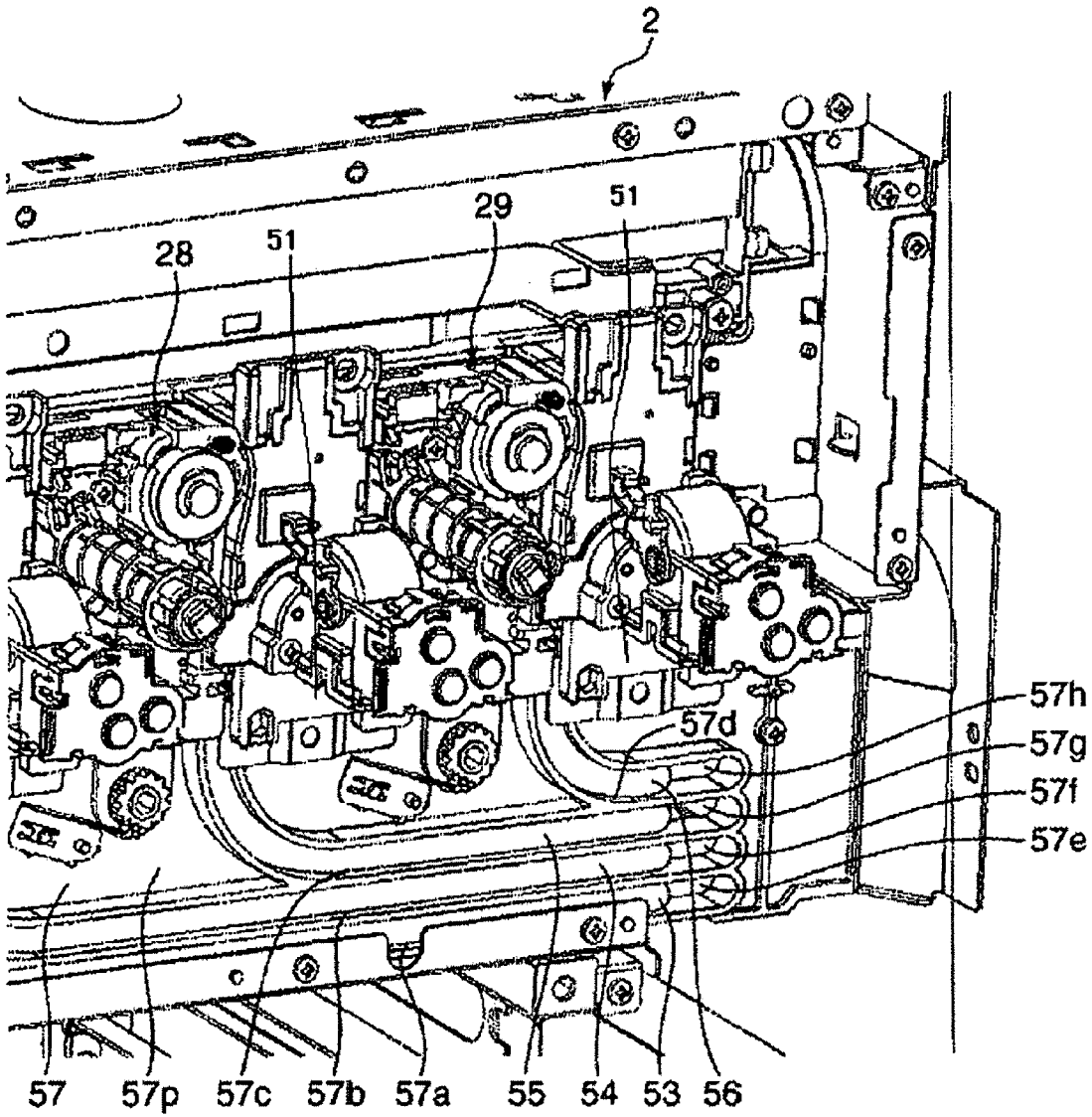
FIG. 4 is a perspective side view showing the principal portion of the apparatus body of the image forming apparatus according to the embodiment of the invention.
Figure 5:
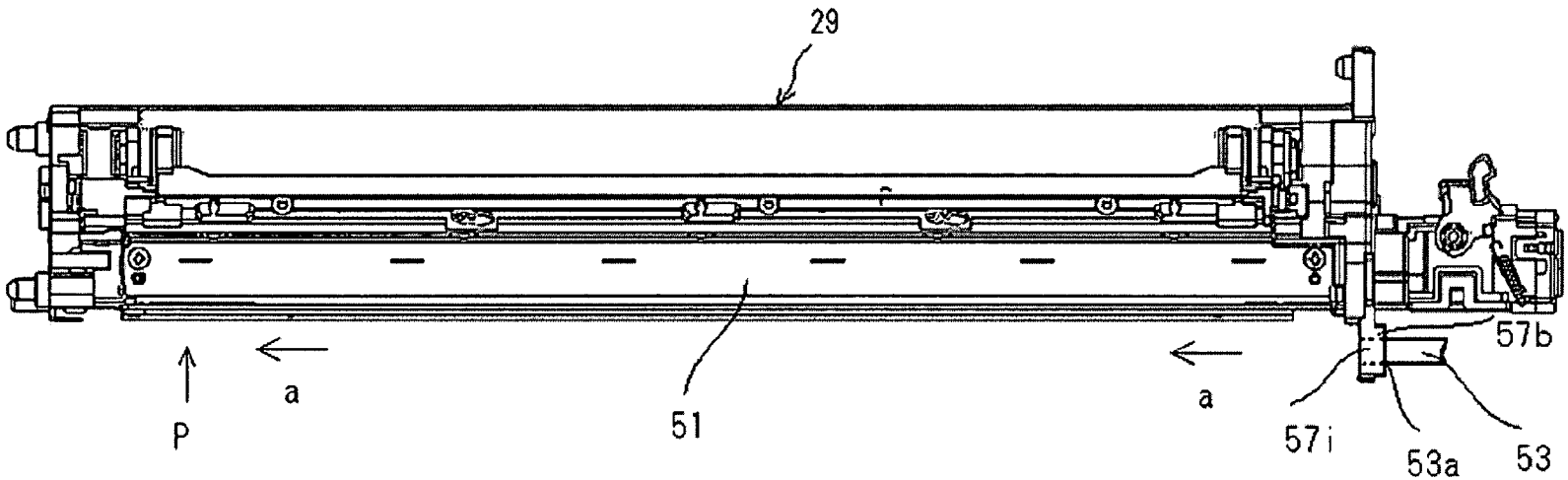
FIG. 5 is a side view showing a positional relationship between the toner box of the image forming unit of the image forming apparatus according to the embodiment of the invention and an air blowoff portion of the flexible tube.

To deal with this problem, in this embodiment, the four toner boxes (portions to be cooled) are cooled with a single cooling fan (airflow producing portion). FIG. 2 is a perspective view showing a positional relationship between the image forming units and the cooling fan, which are provided inside the apparatus body of the image forming apparatus, and FIG. 3 is a perspective view showing how air guide members connect between the image forming units and the cooling fan. FIG. 4 is a perspective side view, as seen from the front, of the principal portion of the apparatus body. FIG. 5 is a side view showing a positional relationship between the black toner box of the image forming unit and an air blowoff portion of the air guide member. The same positional relationship holds true for other non-black color toner boxes.

As shown in FIG. 2, a cooling fan (sirocco fan) 52, which serves as an airflow producing portion, and cooling fans 60 and 61 connected to other portions to be cooled are arranged in a right part of the apparatus body 2. The image forming units 26 to 29 are put into place from the front of the apparatus body 2 toward the rear thereof. As indicated by chain double-dashed lines in FIG. 2, air guide members 53 to 56 guide the air from the cooling fan 52 to the front of the apparatus body 2 toward which the image forming units 26 to 29 face.

As shown in FIG. 3, the cooling fan 52 has four cylindrical air outlets 52*a*. The four flexible tubes 53 to 56 serving as the air guide members are connected to the air outlets 52*a* of the cooling fan 52 with their respective air inlet portions tied in a bundle and inserted into the air outlets 52*a*. Air blowoff portions 53*a* to 56*a* of the flexible tubes 53 to 56 are arranged inside the apparatus body 2 near the bottom surfaces (portions to be cooled) of the toner boxes 51 so as to face the front of the apparatus body 2. The structure of the flexible tubes 53 to 56 will be described in detail later.

As shown in FIG. 4, on the front side of the apparatus body 2, a body frame 57 is disposed below the image forming units 28 and 29. The body frame 57 is provided with a frame side plate 57*p* and grooves 57*a* to 57*d*. The grooves 57*a* to 57*d* extend in parallel in a horizontal direction. The body frame 57 has holes 57*e* to 57*h* on the right side thereof that run from the right rear of the apparatus body 2 toward the front.

The uppermost groove 57*d* extends leftward up to substantially right below the toner box 51 of the fourth image forming unit 29 that forms a yellow (Y) toner image; the groove 57*c* directly below the groove 57*d* extends leftward up to substantially right below the toner box 51 of the third image forming unit 28 that forms a magenta (M) toner image; the groove 57*b* directly below the groove 57*c* extends leftward up to substantially right below the toner box of the unillustrated second image forming unit that forms a cyan (C) toner image; and the lowermost groove 57*a* extends leftward up to substantially right below the toner box of the unillustrated first image forming unit that forms a black (Bk) toner image. The grooves 57*a* to 57*d* extend upward from there to the bottom surfaces of the toner boxes 51.

The flexible tubes 53 to 56 connected to the cooling fan 52 shown in FIG. 3 are passed through the holes 57*e* to 57*h*, respectively, formed in the frame side plate 57*p* shown in FIG. 4, and are then pulled out thereof and fitted in the grooves 57*a* to 57*d*, respectively. In this way, the flexible tubes 53 to 56 extend from the respective positions inside the apparatus body 2 on the right side thereof, where they are connected to the cooling fan 52, up to the bottom surfaces of the toner boxes 51.

Next, with reference to FIG. 5, how the flexible tube 53 is attached to the body frame 57 will be described. The body frame 57 disposed below the toner box 51 has formed therein an insertion hole 57*i*, which is an elliptical hole formed in a boss 57*b*. When the air blowoff portion 53*a* of the flexible tube 53 is inserted into the insertion hole 57*i*, the air blowoff portion 53*a* is compressed according to the shape of the insertion hole 57*i* and is securely fixed to the boss 57*b*. As a result, as indicated by arrow "a" in FIG. 5, the cool air blown out of the air blowoff portion 53*a* of the flexible tube 53 is made to flow from the front toward the rear of the toner box 51 along the bottom surface (member to be cooled) thereof. Similarly, the air blowoff portions of the other flexible tubes 54 to 56 are each inserted into the insertion hole and fixed in place, such that the cool air is blown out of the air blowoff portion thereof and is made to flow along the bottom surface of the toner box 51.

Figure 6:
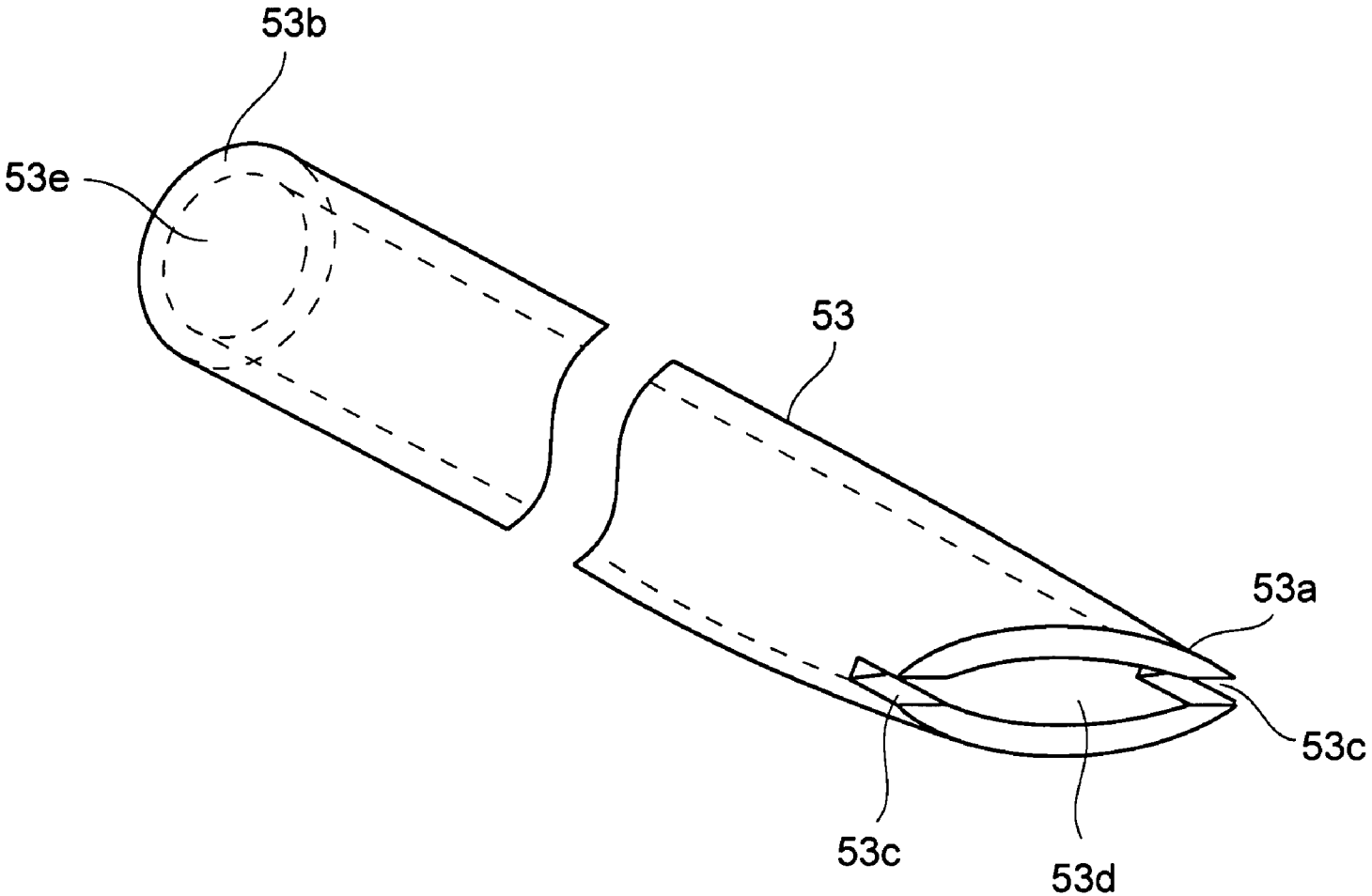
FIG. 6 is a perspective view showing the flexible tube of the image forming apparatus according to the embodiment of the invention.

FIG. 6 is a perspective view showing a flexible tube. Although the flexible tubes 53 to 56 differ in length, they are identical in shape and material. Therefore, the structure such as shape and material of the flexible tubes 53 to 56 will be described, taking up as an example the flexible tube 53.

The flexible tube 53 is made of a cylindrical polyurethane resin, or the like, and has flexibility and heat insulating properties. The flexible tube 53 has, at one end thereof, the air inlet portion 53*b* that is attached to the air outlet 52*a* of the cooling fan 52, such that the air from the cooling fan 52 is passed through a hollow cross-section part 53*e* that is circular in cross section. The flexible tube 53 has, at the other end thereof, the air blowoff portion 53*a* from which the air taken in through the air inlet portion 53*b* is blown out of a hollow cross-section part 53*d* that is elliptical in cross section. The cross-sectional area of the hollow cross-section part 53*d* of the air blowoff portion 53*a* is smaller than that of the hollow cross-section part 53*e* of the air inlet portion 53*b*. The air blowoff portion 53*a* has, at the end face thereof, two slits 53*c* formed in the major axis direction of an ellipse, the two slits being perpendicular to that end face. These two slits 53*c* allow the flexible tube 53 to easily transform into an ellipse, and easily fit into the insertion hole 57*i* of the body frame 57.

Now, a description will be given of how the temperature of a toner box changes differently depending on the cross-sectional area of the hollow cross-section part 53*d* of the air blowoff portion 53*a*. FIG. 7 is a plan view of the air blowoff portion 53*a* of the flexible tube. FIG. 7A shows an air blowoff portion of the embodiment of the invention, and FIG. 7B shows an air blowoff portion of a conventional example.

The air blowoff portion shown in FIG. 7A is an elliptical cylinder having an elliptical cross section consisting of two parts, of which one is an outer ellipse having a major axis of 14.5 mm and a minor axis of 6.4 mm, and the other is an ellipse corresponding to the cross section of the hollow cross-section part through which the air is passed, the ellipse having a major axis of 11.5 mm and a minor axis of 3.4 mm. The cross-sectional area of the elliptical hollow cross-section part is 31 $mm^2$.

Figure 7B:
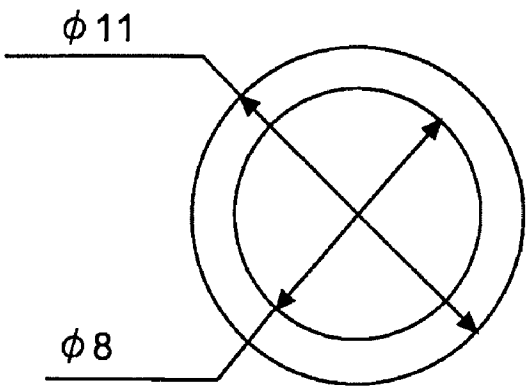
FIG. 7B is a plan view showing the air blowoff portion of a conventional flexible tube.
Figure 7A:
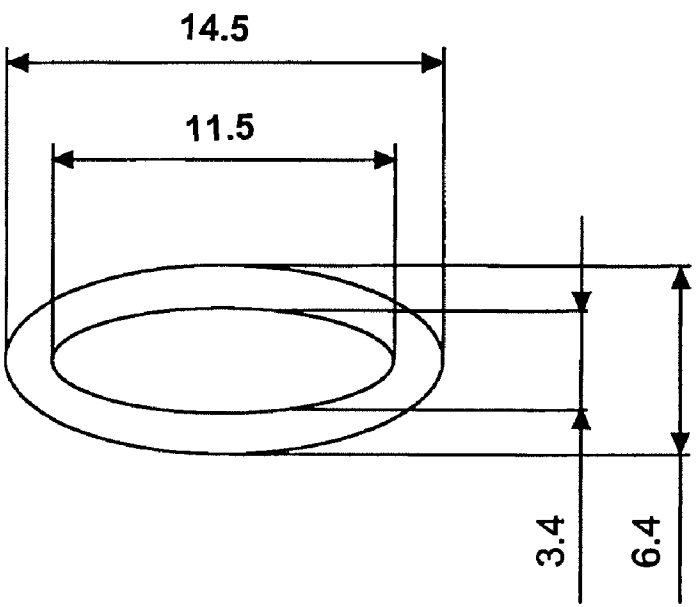
FIG. 7A is a plan view showing the air blowoff portion of the flexible tube of the image forming apparatus according to the embodiment of the invention.
Figure 8A:
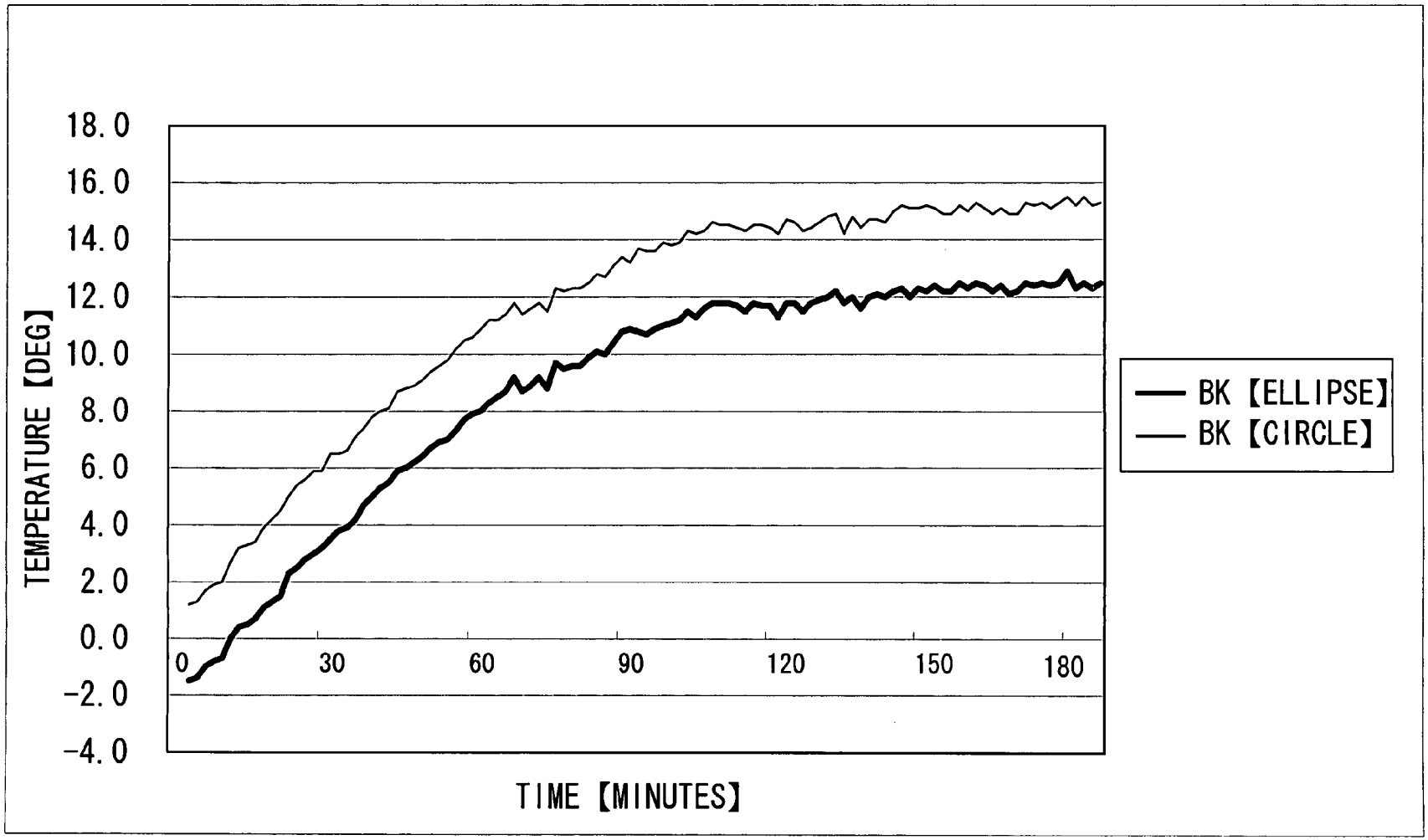
FIG. 8A is a graph showing a change in temperature of the toner box containing black toner, the change in temperature observed for each of different shapes of the air blowoff portion, in the image forming apparatus according to the embodiment of the invention.
Figure 8B:
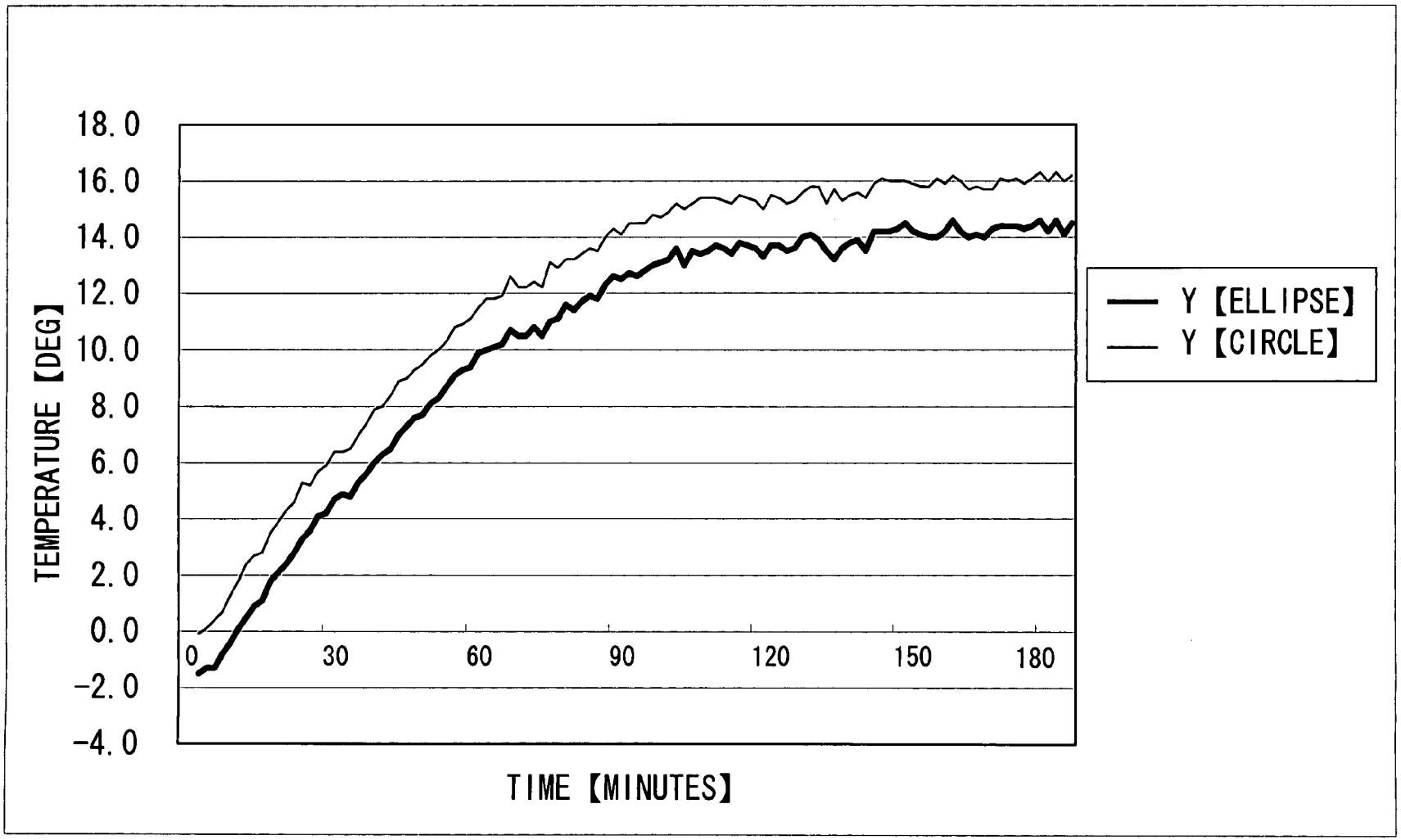
FIG. 8B is a graph showing a change in temperature of the toner box containing yellow toner, the change in temperature observed for each of different shapes of the air blowoff portion, in the image forming apparatus according to the embodiment of the invention.
Figure 8C:
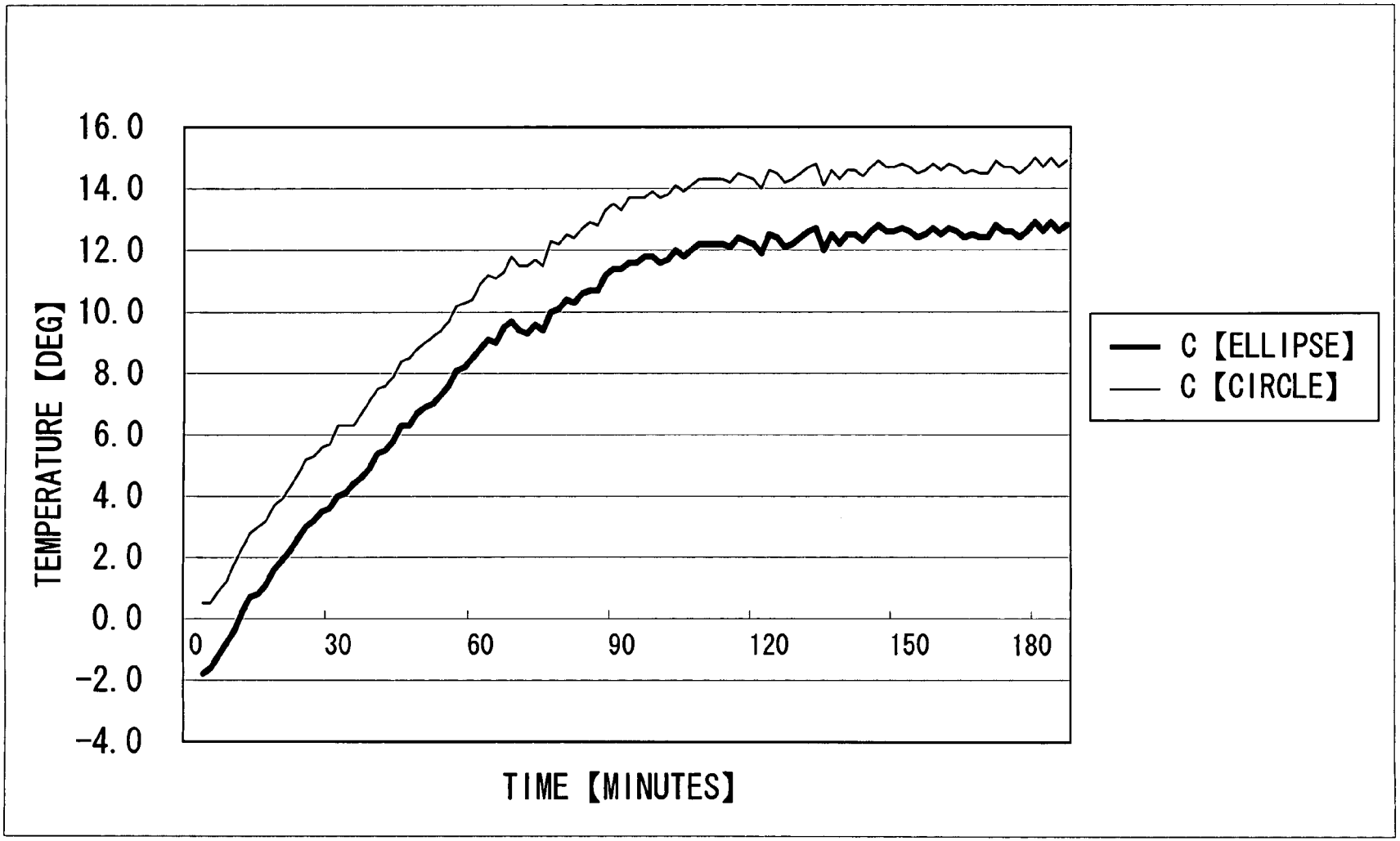
FIG. 8C is a graph showing a change in temperature of the toner box containing cyan toner, the change in temperature observed for each of different shapes of the air blowoff portion, in the image forming apparatus according to the embodiment of the invention.
Figure 8D:
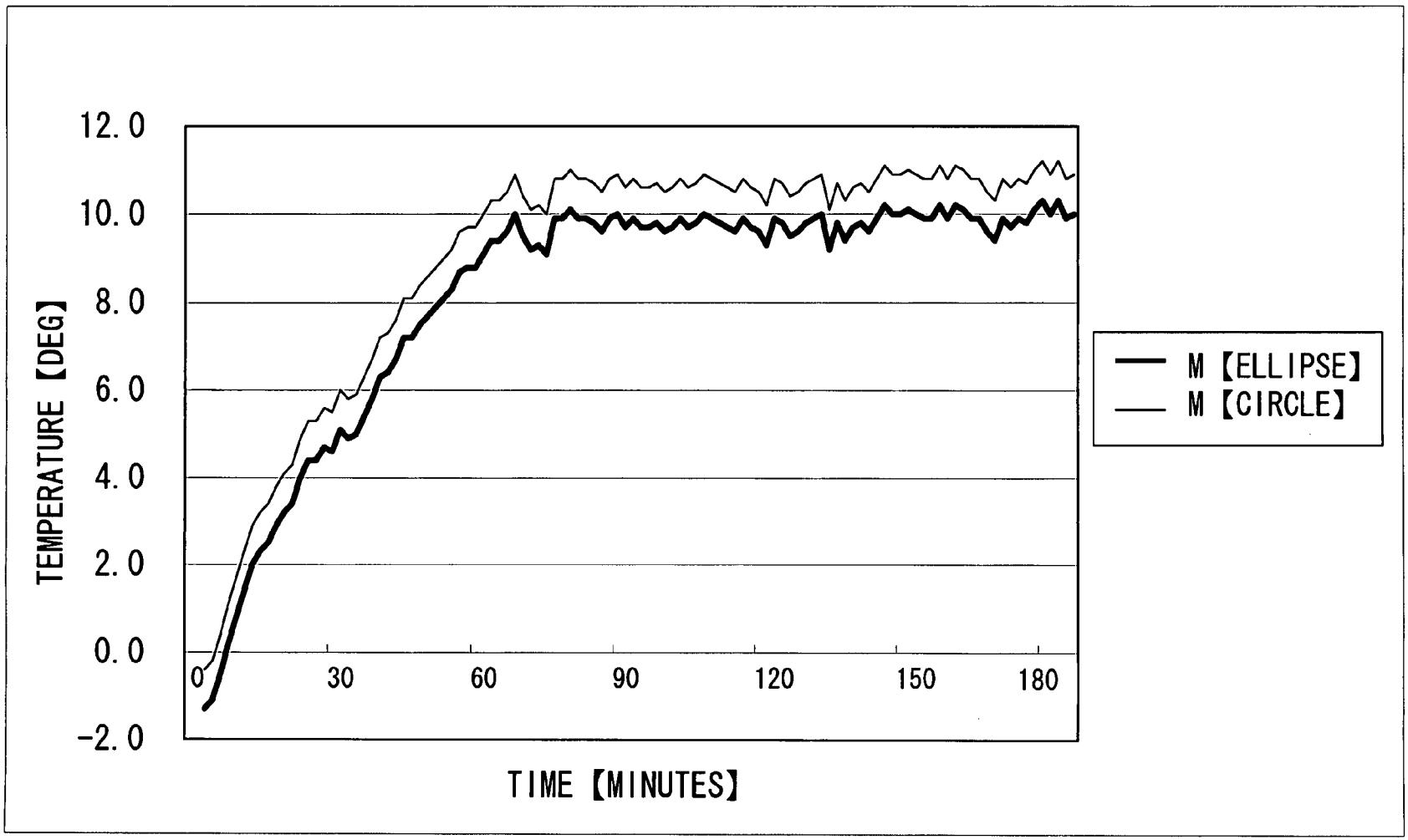
FIG. 8D is a graph showing a change in temperature of the toner box containing magenta toner, the change in temperature observed for each of different shapes of the air blowoff portion, in the image forming apparatus according to the embodiment of the invention.

The air blowoff portion shown in FIG. 7B is a circular cylinder having a circular cross section consisting of two parts, of which one is an outer circle having a diameter of 11 mm, and the other is a circle corresponding to the cross section of the hollow cross-section part, the circle having a diameter of 8 mm. The cross-sectional area of the circular hollow cross-section part is 50 $mm^2$.

Both the embodiment and the conventional example make the cooling fan 52 take in air from outside the apparatus in the same manner, and the air inlet portions 53*b* to 56*b* through which the air is taken in from the cooling fan 52 and is made to flow through the flexible tubes 53 to 56 have the shape and dimensions shown in FIGS. 7A and 7B.

FIGS. 8A to 8D show how the temperature of the toner boxes 51 for black toner (Bk), yellow toner (Y), cyan toner (C), and magenta toner (M), respectively, rises with time differently depending on the cross-sectional area of the hollow cross-section part (in FIGS. 8A to 8D, what is indicated by an "ellipse" is the results of the embodiment, and what is indicated by a "circle" is the results of the conventional example). The horizontal axis represents time (in minutes), and the vertical axis represents a rise in temperature (in degrees) from room temperature. The temperature is measured on the bottom surface of each toner box 51 at the rear of the apparatus body 2 (at point P indicated by an arrow in FIG. 5).

As shown in FIGS. 8A to 8D, as the image forming apparatus 1 continuously performs image forming operation, the measured temperature of each toner box 51 rises and is then gradually stabilized. With the elliptical air blowoff portion of the embodiment, the maximum rise in temperature observed in this measurement environment during the measurement period is 12.9 degrees for black toner (Bk), 14.8 degrees for yellow toner (Y), 13.1 degrees for cyan toner (C), and 10.4 degrees for magenta toner (M), which are lower than those observed with the circular air blowoff portion of the conventional example by 2.7 degrees, 1.7 degrees, 2.1 degrees, and 0.9 degrees, respectively. Incidentally, the temperature of black toner (Bk) is supposed to be more likely to rise than the temperature of toner of other colors, because the toner box for black toner (Bk) is disposed nearest the fusing unit 14; in actuality, however, since the cooling air coming from other cooling devices (not shown) is blown onto the rear end of the toner box for black toner (Bk), the rise in temperature of black toner (Bk) is smaller than that of yellow toner (Y).

These results indicate that, since the cross-sectional area of the hollow cross-section part of the elliptical air blowoff portion 53*a*, the hollow cross-section part through which air is passed, is smaller than that of the circular air blowoff portion, the elliptical air blowoff portion 53*a* can blow off the air at higher wind velocity than the circular air blowoff portion, and accordingly make relatively cool outside air reach all the way to the rear end of the toner box 51 at a faster rate, thereby lowering the temperature of the toner box 51.

According to this embodiment, there are provided the cooling fan 52 for taking in air outside the apparatus, and the flexible tubes 53 to 56 that guide the air thus taken in toward the toner boxes 51 of four different colors to cool them. The flexible tubes 53 to 56 respectively have the air inlet portions 53*b* to 56*b* through which the air from the cooling fan 52 is taken in, and the air blowoff portions 53*a* to 56*a* that send the air to the respective toner boxes 51. The cross-sectional area of the hollow cross-section part of each of the air blowoff portions 53*a* to 56*a*, the hollow cross-section part through which the air is passed, is smaller than the cross-sectional area of the hollow cross-section part of each of the air inlet portions 53*b* to 56*b*, the hollow cross-section part through which the air is passed. With this structure, the cooling fan 52 takes in the air outside the apparatus, and then sends the air thus taken in through the air inlet portions 53*b* to 56*b* of the flexible tubes 53 to 56. The air is passed through the air blowoff portions 53*a* to 56*a*, and is then made to flow from the front toward the rear of the apparatus body 2 along the bottom surfaces of the toner boxes 51. This helps prevent the rise in temperature of the toner box 51 not only near the front end of the apparatus body 2 but also near the rear end thereof. As a result, the flowability of toner inside the toner box 51 is improved, making it possible to form high and stable quality images. In addition, there is no need for a larger and higher-performance cooling fan 52 to increase, for example, the quantity of air supplied by the cooling fan 52, making it possible to achieve a reduction in size as well as in the cost of the apparatus.

Moreover, the flexible tubes 53 to 56 through which the air outside the apparatus is sent from the cooling fan 52 toward the toner boxes 51 can be transformed into a shape that allows them to fit through a narrow space in the apparatus body 2. As a result, even when there is no space between the air outlet 52*a* of the cooling fan 52 and each toner box 51 for installation of a duct, it is possible to dispose the flexible tubes 53 to 56 near the toner boxes 51. This makes miniaturization of the apparatus possible.

In addition, the cross-sectional shape of the hollow cross-section part of the air blowoff portions 53*a* to 56*a* of the flexible tubes 53 to 56, the hollow cross-section part through which the air is passed, is elliptical. Such an elliptical hollow cross-section part of the air blowoff portions 53*a* to 56*a* can be easily formed by transforming a cylindrical tube into an elliptical tube by, for example, applying a force on the periphery of the cylindrical tube from opposite directions.

Furthermore, the air blowoff portions 53*a* to 56*a* have slits 53*c* to 56*c* at the end face thereof. These slits allow the cylindrical tube to easily transform by the application of a force on the periphery thereof from opposite directions. This makes it possible to easily make smaller the section of the hollow cross-section parts of the air blowoff portions 53*a* to 56*a*, the hollow cross-section parts through which the air is passed, and allow the air blowoff portions 53*a* to 56*a* to easily fit into the elliptical insertion holes 57*i* of the body frame 57.

Incidentally, the embodiment described above deals with a case in which the toner boxes for color print are taken as examples of the member to be cooled. This, however, is not meant to limit the application of the invention in any way; the invention can also be applied to a single toner box for monochrome print.

The embodiment described above deals with a case in which the toner boxes for color print are taken as examples of the member to be cooled. This, however, is not meant to limit the application of the invention in any way; the invention can also be applied to the third conveying path 11 disposed near the fusing unit 14 shown in FIG. 1.

As shown in FIG. 1, in the fusing unit 14, the paper to which the toner images are transferred is subjected to heat and pressure with the fusing roller 45 and the pressure roller 44, respectively, and the toner images are fused to the surface of the paper, whereby a full-color image is formed. In the third conveying path 11, the paper on which the full-color image is formed is guided into the downstream-side conveying path 47, and is then ejected into the paper ejecting portion 3 with the conveying roller 48 and the ejection roller 24.

Here, if the paper to which the toner images are transferred contains moisture, the heat generated by the built-in heater of the fusing roller 45 turns air into hot, moisture-laden air, and this air moves upward through the third conveying path 11. In the third conveying path 11, the hot, moisture-laden air hits a guide plate forming the downstream-side conveying path 47, turning into water droplets, and these water droplets are adhered to the guide plate. When the conditions are like this, if the paper to which the toner images are fused is guided by the guide plate of the downstream-side conveying path 47, the water droplets are adhered to the paper.

However, as described in this embodiment, by sending air outside the apparatus through the flexible tube connected to the cooling fan 52 toward the member to be cooled, in this case, the third conveying path 11, and making the cross-sectional area of the hollow cross-section part of the air blowoff portion of the flexible tube, the hollow cross-section part through which the air is passed, smaller than the cross-sectional area of the hollow cross-section part of the air inlet portion attached to the cooling fan 52, the air outside the apparatus is sent from the front, where the air blowoff portion pointing toward the third conveying path 11 is located, toward the rear of the apparatus body 2. As a result, even if hot, moisture-laden air is generated as a result of the paper containing moisture being subjected to the fusing process, the cool air that prevents the rise in temperature of the third conveying path 11 from the front toward the rear of the apparatus body 2 diffuses the hot, moisture-laden air. This helps prevent the water droplets from adhering to the guide plate and smearing the image formed on the paper subjected to the fusing process. As a result, it is possible to form high and stable quality images.

The embodiment described above deals with a case in which the air guide member is formed as a flexible tube. This, however, is not meant to limit the application of the invention in any way; the air guide member may be formed as a duct made of aluminum or the like. The material of the air guide member is not limited to a polyurethane resin, but may be of any other heat insulation material that absorbs less heat generated in the apparatus. Furthermore, the shape of the air guide member is not limited to cylindrical; the air guide member may be rectangular or any other shape.

The embodiment described above deals with a case in which the cross-sectional shape of a hollow cross-section part of the air blowoff portion of the air guide member, the hollow cross-section part through which the air is passed, is elliptical. This, however, is not meant to limit the application of the invention in any way; the cross-sectional shape of the hollow cross-section part of the air blowoff portion may be circular, rectangular, or any other shape, as long as the cross-sectional area of the hollow cross-section part of the air blowoff portion, the hollow cross-section part through which the air is passed, is smaller than that of the air inlet portion.

The present invention can be used in image forming apparatuses such as copiers, printers, and facsimiles. In particular, the present invention can be used in a developing device and a conveying device for conveying the paper subjected to the fusing process.

What is claimed is:

1. An image forming apparatus, comprising:

a housing;

a member to be cooled provided inside the housing, wherein in the member to be cooled heat builds up;

an airflow producing portion provided in a predetermined position of the housing for taking in air outside the housing;

an air guide member for passing the air thus taken in through a hollow cross-section part, and guiding the air to the member to be cooled to cool the member to be cooled;

an air inlet portion provided at one end of the air guide member for taking in the air from the airflow producing portion; and an air blowoff portion provided at another end of the air guide member for sending the air to the member to be cooled, wherein in the air blowoff portion a cross-sectional area of the hollow cross-section part is smaller than a cross-sectional area of the hollow cross-section part in the air inlet portion, and wherein a cross-sectional shape of the hollow cross-section part in the air blowoff portion is elliptical.

2. The image forming apparatus of claim 1, wherein the air guide member is formed as a tube having flexibility.

3. The image forming apparatus of claim 2, wherein the air guide member is formed as a tube having heat insulating properties.

4. The image forming apparatus of claim 2, wherein the air blowoff portion is attached to an elliptical hole formed in the housing.

5. The image forming apparatus of claim 2, wherein, when the air blowoff portion is inserted into a hole formed in the housing, the air blowoff portion is transformed according to a shape of the hole and is fixed in the hole.

6. The image forming apparatus of claim 1, wherein the air blowoff portion has a slit formed at an end face thereof in a direction perpendicular to the end face.

7. The image forming apparatus of claim 1, wherein the air blowoff portion sends the air along a bottom surface of the member to be cooled.

8. The image forming apparatus of claim 1, wherein the member to be cooled extends in a lengthwise direction thereof, and, at one end thereof in the lengthwise direction, the air blowoff portion is disposed.

9. The image forming apparatus of claim 1, wherein the member to be cooled is a toner box containing toner.

10. The image forming apparatus of claim 9, wherein the air blowoff portion sends the air along a bottom surface of the toner box.

11. The image forming apparatus of claim 9, wherein the toner box extends in a lengthwise direction thereof, and, at one end thereof in the lengthwise direction, the air blowoff portion is disposed.

12. The image forming apparatus of claim 9, wherein the air guide member is formed as a tube having flexibility.

13. The image forming apparatus of claim 12, wherein the airflow producing portion comprises one airflow producing portion provided in a predetermined position of the housing, wherein the toner box comprises a plurality of toner boxes provided inside the housing, wherein the air guide member comprises a plurality of air guide members, each taking in the air from the airflow producing portion and guiding the air to a corresponding one of the toner boxes.

14. The image forming apparatus of claim 1, further comprising:

a fusing unit provided inside the housing for fusing a toner image to paper by applying heat and pressure to the paper; and a paper conveying portion provided on a downstream side of the fusing unit along a paper conveying direction for conveying the paper to which the toner image is fused, wherein the member to be cooled is the paper conveying portion.

15. The image forming apparatus of claim 14, wherein the air blowoff portion is disposed at one end in a direction perpendicular to the paper conveying direction of the paper conveying portion.

16. The image forming apparatus of claim 15, wherein the paper conveying portion is disposed above the fusing unit.

17. The image forming apparatus of claim 16, wherein the air guide member is formed as a tube having flexibility.

18. An image forming apparatus, comprising:

a housing;

a member to be cooled provided inside the housing, wherein in the member to be cooled heat builds up;

an airflow producing portion provided in a predetermined position of the housing for taking in air outside the housing;

an air guide member for passing the air thus taken in through a hollow cross-section part, and guiding the air to the member to be cooled to cool the member to be cooled, the air guide member being formed as a tube having flexibility;

an air inlet portion provided at one end of the air guide member for taking in the air from the airflow producing portion; and an air blowoff portion provided at another end of the air guide member for sending the air to the member to be cooled, wherein in the air blowoff portion a cross-sectional area of the hollow cross-section part is smaller than a cross-sectional area of the hollow cross-section part in the air inlet portion, and a cross-sectional shape of the hollow cross-section part has a first length in a first direction and a second length in a second direction, the first length and the second length being different and perpendicular to each other.

19. The image forming apparatus according to claim 18, wherein, when the air blowoff portion is inserted into a hole formed in the housing, the air blowoff portion is transformed according to a shape of the hole and is fixed in the hole.

* * * * *